US007846272B2

(12) United States Patent
Michler

(10) Patent No.: US 7,846,272 B2
(45) Date of Patent: Dec. 7, 2010

(54) TREATED AUSTENITIC STEEL FOR VEHICLES

(75) Inventor: Thorsten Michler, Hofheim (DE)

(73) Assignee: GM Global Technology Operations, Inc., Detroit, MI (US)

( * ) Notice: Subject to any disclaimer, the term of this patent is extended or adjusted under 35 U.S.C. 154(b) by 159 days.

(21) Appl. No.: 11/796,417

(22) Filed: Apr. 27, 2007

(65) Prior Publication Data

US 2007/0295427 A1 Dec. 27, 2007

Related U.S. Application Data

(60) Provisional application No. 60/796,257, filed on Apr. 28, 2006.

(51) Int. Cl.

| | |
|---|---|
| ***C23C 8/32*** | (2006.01) |
| ***C23C 8/30*** | (2006.01) |
| ***C23C 8/28*** | (2006.01) |
| ***C23C 8/08*** | (2006.01) |
| ***C23C 8/20*** | (2006.01) |
| ***C23C 8/22*** | (2006.01) |
| ***C23C 8/24*** | (2006.01) |
| ***C23C 8/26*** | (2006.01) |

(52) U.S. Cl. ..... 148/218; 148/210; 148/212; 148/225; 148/230; 148/238

(58) Field of Classification Search ..... 148/210, 148/212, 218, 225, 230, 238
See application file for complete search history.

(56) References Cited

U.S. PATENT DOCUMENTS

| | | | | |
|---|---|---|---|---|
| 6,238,490 | B1 * | 5/2001 | Bell et al. | 148/222 |
| 2006/0034724 | A1 * | 2/2006 | Hamano et al. | 420/39 |
| 2006/0061043 | A1 * | 3/2006 | Takahashi et al. | 277/434 |
| 2006/0090817 | A1 * | 5/2006 | Somers et al. | 148/218 |

FOREIGN PATENT DOCUMENTS

| | | | |
|---|---|---|---|
| DE | 698 03 389 T2 | | 8/2002 |
| JP | 04-263071 | * | 9/1992 |
| WO | WO 2005/124910 A1 | | 12/2005 |
| WO | WO 2006/036241 A2 | | 4/2006 |

OTHER PUBLICATIONS

"Effect of N2 to C2H2 ratio on r.f. plasma surface treatment of austenitic stainless steel", Surface and Coatings Technology 183 (2004) 268-274.

* cited by examiner

*Primary Examiner*—Stuart Hendrickson
*Assistant Examiner*—Daniel Berns

(57) ABSTRACT

A treated austenitic steel and method for treating same includes an austenitic steel and a non-metal chemical element incorporated into a surface of the steel. The surface has a bi-layered structure of a compound layer at a top and an underlying diffusion layer, which protects said surface against hydrogen embrittlement.

6 Claims, 19 Drawing Sheets

FIG 18
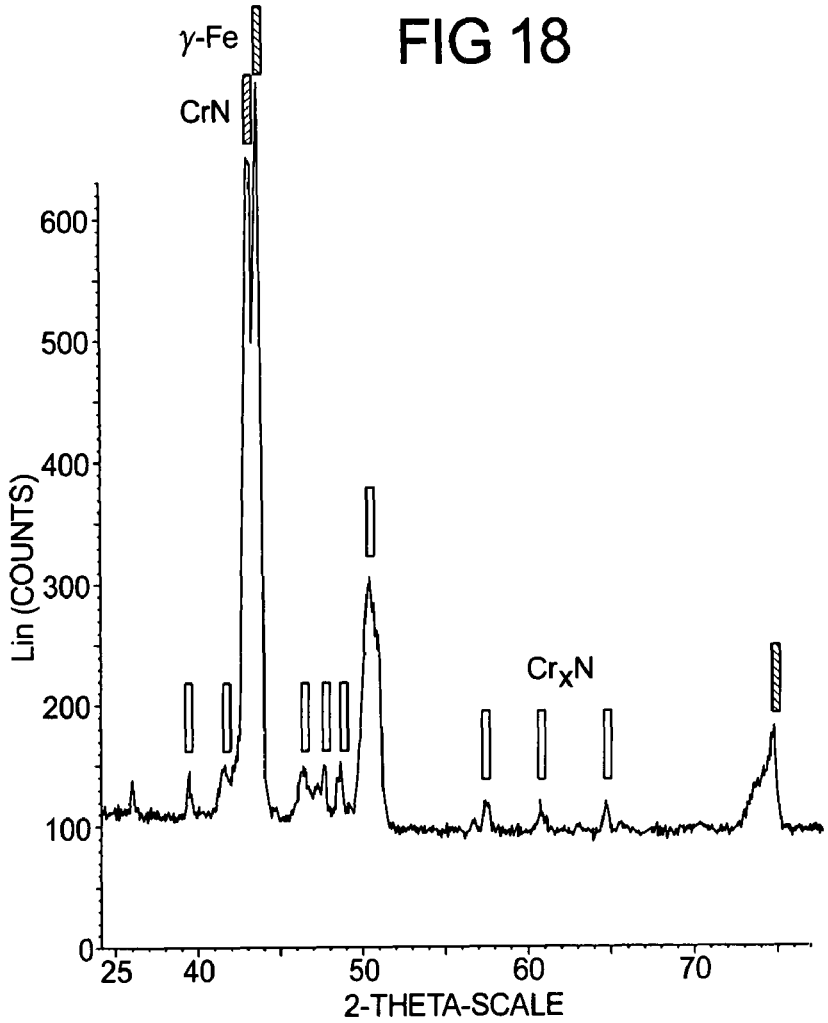
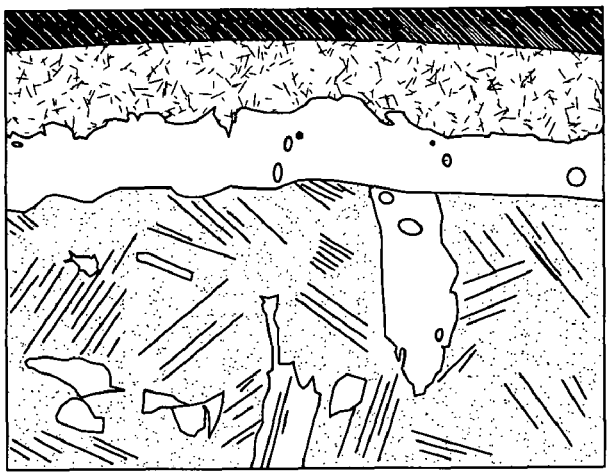
FIG 19

TREATED AUSTENITIC STEEL FOR VEHICLES

CROSS REFERENCE TO RELATED APPLICATION

This application claims the benefit of U.S. Provisional Patent Application Ser. No. 60/796,257, filed Apr. 28, 2006.

TECHNICAL FIELD

The present invention relates generally to austenitic steel and, more particularly, to treating austenitic steel with plasma nitriding or carbonizing to protect the steel against hydrogen embrittlement for use in vehicles.

BACKGROUND OF THE INVENTION

It is known to provide hydrogen tanks for fuel-celled vehicles. In these vehicles, steels of the types 18/10-Cr/Ni or 18/12-Cr/Ni, for example 1.4404, 1.4435 or 1.4571, are used for hydrogen storage and supply components. These steels are meta-stable steels, even though it requires a rather severe cooling and deformation to cause a martensite change. Because of the increased addition of Ni, these steels are more expensive than those of the type 18/8-Cr/Ni. Nitrogen is not a typical alloy element in these types of steels. Currently, these steels are used due to the existence of hydrogen embrittlement. However, due to the meta-stability of the material, brittleness may still exist.

The phenomenon of hydrogen embrittlement of a material, in particular steel, is well known in the art. The hydrogen penetrates the structure of the material and compromises its integrity. The hydrogen reduces the material's mechanical qualities, in particular its ductility such as elongation at fracture (A) or Reduction of Area (Z). Depending on the structure, some steels are very sensitive to hydrogen embrittlement. A number of studies have shown that the sensitivity to hydrogen embrittlement is lower with the cubic face centered (fcc) austenitic structure than the cubic body centered (bcc) ferritic/martensitic structure.

Austenitic steels can be divided into stable austenitic steels and meta-stable austenitic steels. The stable austenite, the austenitic structure, is not altered, regardless of how cold the working temperature is and/or how large the deformation. The cause of this stability is the large portion of austenitic alloy elements, in particular, nickel, manganese, nitrogen, and to a smaller degree carbon (to 2%). A typical representative of this steel is DIN1.4439. The carbon content is usually limited to about 0.03 wt %.

The meta-stable austenite is partially converted to martensite by cooling and/or deformation of the material. Typical representative types of steel are those of type 18/8-Cr/Ni, for example, DIN1.4301/AISI304. The carbon content is usually limited to about 0.07 wt % due to the formation of chrome carbides during manufacturing of the steel. On the other hand, carbon stabilizes the austenitic structure.

Nitrogen is not a typical alloy element for these kinds of steels, but nitrogen stabilizes the austenitic structure when incorporated in a certain amount. It is further known that, when the material is exposed in a hydrogen atmosphere, any damage to the material with tend to cause a tear (fracture) to propagate at the surface of the material.

The most common materials used for hydrogen applications are stainless steel because of their low susceptibility to environmental hydrogen embrittlement (HEE). Stainless steel can be divided into stable and meta-stable grades. Since at meta-stable grades (typically those of types 18Cr-8Ni) parts of the structure undergo a transformation from face centered cubic (fcc) austenite to body centered cubic (bcc) $\alpha'$ martensite when cold formed and/or cooled down to very low temperatures, the structure of stable austenitic steels (typically those of types 18Cr-12Ni) remains austenitic independent of the operating or work hardening conditions.

For stationary hydrogen tanks where cost and weight are of minor importance, grade Cr18-Ni10 steels of types 1.4404 (AISI 316L) or 1.4571 (316 Ti) are widely and successfully used. Usually, wall thicknesses are quite high which results in a low failure probability. Nickel is the cost driver in stainless steel, which makes these grades unattractive for automotive vehicle applications where cost and weight are of major importance. Unfortunately meta-stable grades like DIN 1.4301 (AISI 304) suffer from severe HEE whereas the influence of hydrogen on grade AISI 316L is slight or negligible. It is known that the fcc austenitic structure is quite insensitive to HEE and that the severe HEE of meta-stable grades can be attributed to the $\gamma$-$\alpha'$-transformation.

The main phenomena of HEE are shown in FIG. 1. Hydrogen enters the material via adsorption and dissociation of the $H_2$ molecule followed by absorption of the H proton, while the electron is released into the free electron gas of the metal. The H protons diffuse into areas of high tensile stresses where they accumulate and embrittle the material. The most plausible theories are the "decohesion theory" and the "HELP theory". While the atomistic processes of hydrogen embrittlement are not quite understood yet, it is common sense that hydrogen enters the metallic structure via the above-described surface or near surface processes (adsorption, dissociation, absorption, and diffusion). One precondition for these processes to take place is the destruction of the oxide layer due to local plastic strain. The heat released by local plastic deformation provides enough energy so that adsorption, dissociation, and absorption can take place easily on the newly formed (not oxidized) metal surfaces.

Thus, it is desirable to stabilize the austenitic structure of the steel. Ni, Mn, C, and N are the elements that stabilize the austenitic structure, of which C and N are the most inexpensive ones. It is also desirable to incorporate compressive stresses that counteract with external tensile stresses. It is further desirable to reduce or suppress diffusivity of hydrogen in the lattice. It is still further desirable to control surface processes (adsorption, dissociation, absorption, and diffusion) so that the hydrogen cannot enter the lattice. It is yet further desirable to use specific gas impurities like oxygen for a spontaneous reformation of the oxide layer, which inhibits the entire process. Therefore, there is a need in the art to treat austenitic steel that meets at least one of these desires.

SUMMARY OF THE INVENTION

Accordingly, the present invention is a treated austenitic steel including an austenitic steel and a non-metal chemical element incorporated into a surface of the steel. The surface has a bi-layered structure of a compound layer at a top and an underlying diffusion layer, which protects the surface against hydrogen embrittlement.

Additionally, the present invention is a method of treating austenitic steel against hydrogen embrittlement. The method includes the steps of providing an austenitic steel and incorporating a non-metal chemical element into a surface of the steel. The method also includes the step of producing a bi-layered structure in the surface of the steel comprising a compound layer at a top and an underlying diffusion layer, which protects the surface against hydrogen embrittlement.

One advantage of the present invention is that treating of austenitic steel by plasma nitriding or carbonizing is provided for components of a vehicle. Another advantage of the present invention is that, for hydrogen applications such as hydrogen storage and supply components of a vehicle, by treating the austenitic steel, a nitriding layer primarily of interstitial diluted nitrogen (metal nitrides, carbides or other phases may be also present in more or less quantities) stabilizes the austenitic structure in the near surface region, which leads to a material not or only slightly affected by hydrogen. Yet another advantage of the present invention is that, by treating the austenitic steel, the interstitial dilution of nitrogen (N) leads to compressive stresses that counteract the operational tensile stresses. Still another advantage of the present invention is that, by treating the austenitic steel, the interstitial dilution of N reduces the diffusion speed of H because interstitial sites are blocked by N. A further advantage of the present invention is that treating austenitic steel by plasma nitriding improves the stability of the structure and improves durability. Yet a further advantage of the present invention is that treating austenitic steel by plasma nitriding or carbonizing allows immediate implementation, because no special steel alloy is necessary. Still a further advantage of the present invention is that treating austenitic steel by treating austenitic steel by plasma nitriding or carbonizing provides high structural integrity, because the material shows structural stability necessary for hydrogen applications. Another advantage of the present invention is that treating austenitic steel by plasma nitriding or carbonizing results in relatively low cost because the structural stability results in the replacement of high cost Ni with low cost N or C (e.g., in cf 1.4439).

Other features and advantages of the present invention will be readily appreciated, as the same becomes better understood, after reading the subsequent description taken in conjunction with the accompanying drawings.

BRIEF DESCRIPTION OF THE DRAWINGS

FIG. 18 is a graph of the XRD pattern of the diffusion layer of the plasma nitrided austenitic steel of FIG. 17.

FIG. 19 is a view similar to FIG. 17 after plastic deformation of 35%.

DESCRIPTION OF THE PREFERRED EMBODIMENT

Figure 1:
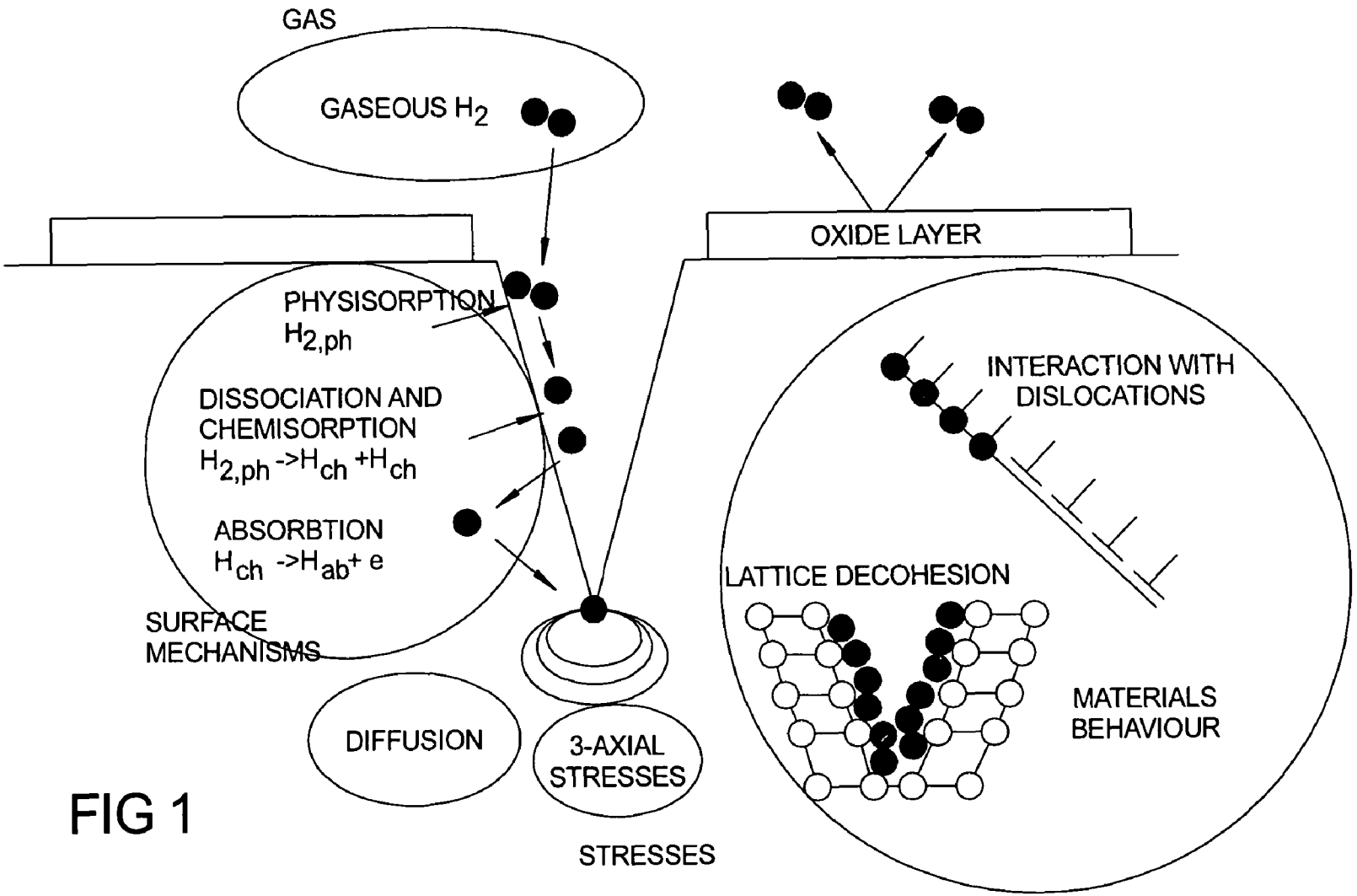
FIG. 1 is a diagrammatic view of main phenomena of hydrogen embrittlement of an austenitic steel.

Referring to the drawings, except for FIG. 1, one embodiment of a treated austenitic steel is shown. The treated austenitic steel includes an austenitic steel and a non-metal chemical element incorporated into a surface of the steel. The surface has a bi-layered structure of a compound layer at a top and an underlying diffusion layer, which protects the surface against hydrogen embrittlement.

The austenitic steel is stainless steel and the non-metal chemical element is at least one of carbon (C) and nitrogen (N). The carbon and nitrogen are interstitial diluted in the austenitic steel. The compound layer is an S-phase compound layer and the diffusion layer is an intermediate $\gamma/\gamma_C$-layer. The austenitic steel may be nitrided and/or tensile strained.

Tensile test specimen (type DIN 50125-B16×80) made of meta-stable austenitic stainless steel 1.4301/AISI 304 (solution treated) were plasma nitrided at 430° C. with different $N_2$ to $H_2$ ratios (10, 33 and 66 vol % $N_2$). The heating process was supported by an Ar—$H_2$ discharge. The chemical composition of the steel as well as the calculated $M_s$ and $M_{d30}$ temperatures are given in Table 1.

TABLE 1

Chemical composition of 1.4301 stainless steel. All elements in wt %, $M_s$ and $M_{d30}$ in ° C.

| Steel | C | Si | Mn | P | S | Cr | Mo | Ni | N | Cu | $M_s$ | $M_{d30}$ |
|---|---|---|---|---|---|---|---|---|---|---|---|---|
| 1.4301 | 0.02 | 0.41 | 1.37 | 0.024 | 0.022 | 18.18 | 0.34 | 8.04 | 0.056 | 0.38 | −124 | 31 |

Plastic strains $\epsilon_{pl}$ of 5, 15, 25 and 35% were incorporated into not nitrided and plasma nitrided specimen using a conventional tensile test machine. Optical microscopy was performed to assess the structure of the nitriding layer and the base material. All microprobes were etched by nitrohydrochloric acid unless indicated otherwise. X-ray diffraction (XRD) using Cu—$K_{60}$ radiation and glow discharge optical spectroscopy (GDOES) were performed. SIMS was performed.

Martensite contents were measured with a Feritscope MP30E-S by Fischer GmbH, Sindelfingen, Germany. The Feritscope readings were multiplied by a factor of 1.7 to get the martensite contents. Tensile tests in gaseous hydrogen at 1 bar, 20° C. and a slope of 0.1 mm/min were performed.

Figure 2:
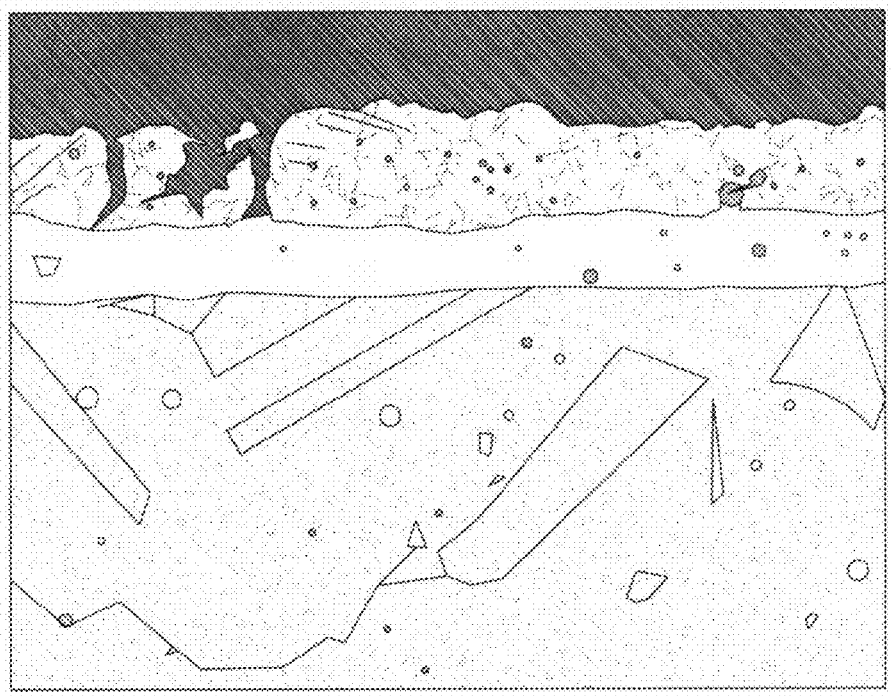
FIG. 2 is an optical photograph of a treated austenitic steel, according to the present invention, plasma nitrided with 66% $N_2$.
Figure 3:
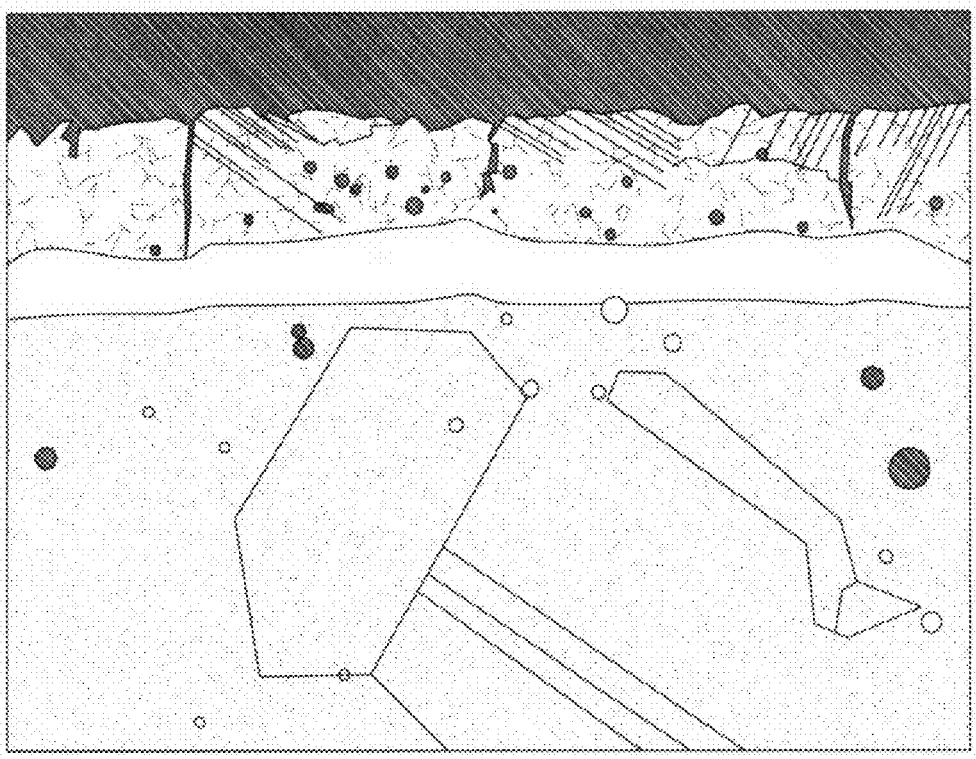
FIG. 3 is an optical photograph of a treated austenitic steel, according to the present invention, plasma nitrided with 33% $N_2$.
Figure 4:
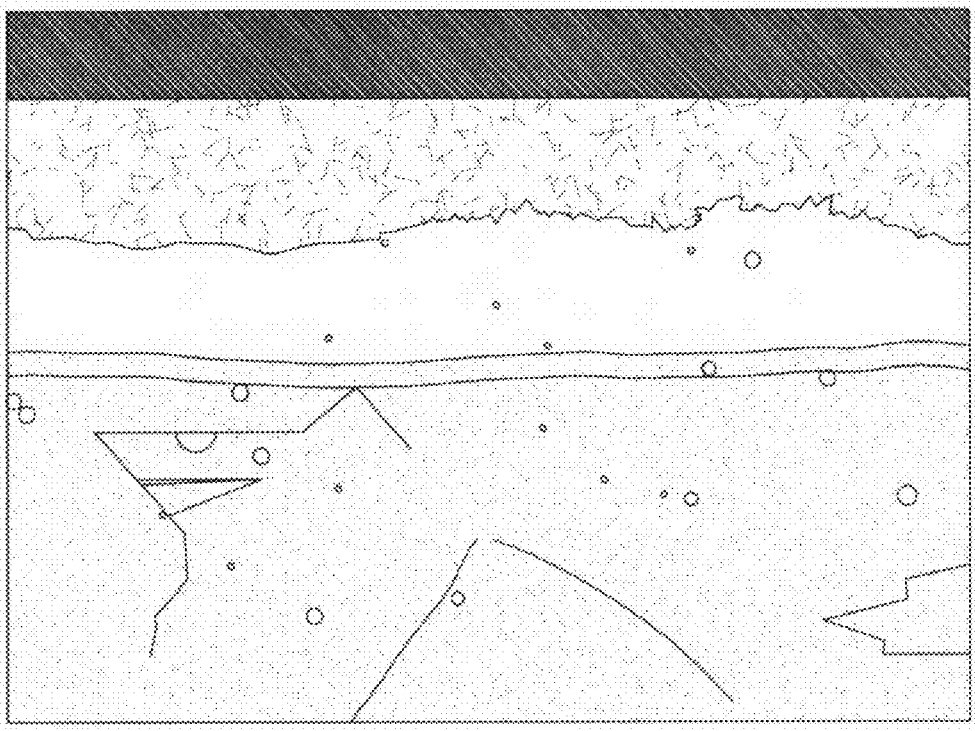
FIG. 4 is an optical photograph of a treated austenitic steel, according to the present invention, plasma nitrided with 10% $N_2$.

FIGS. 2 through 4 show the micrographs of the plasma nitrided surfaces with decreasing $N_2$ content in the gas. The base material shows the typical austenitic structure with twins, Ti-carbonitrides and a quite high amount of non-metallic inclusions. At all $N_2$ to $H_2$ gas ratios a bi-layered structure comprising a compound layer at the top and an underlying intermediate layer was formed. It should be appreciated that the thickness of the compound layer remained quite constant, but the thickness of the intermediate layer increased with decreasing $N_2$ content from 6 to 11 μm.

Figure 5:
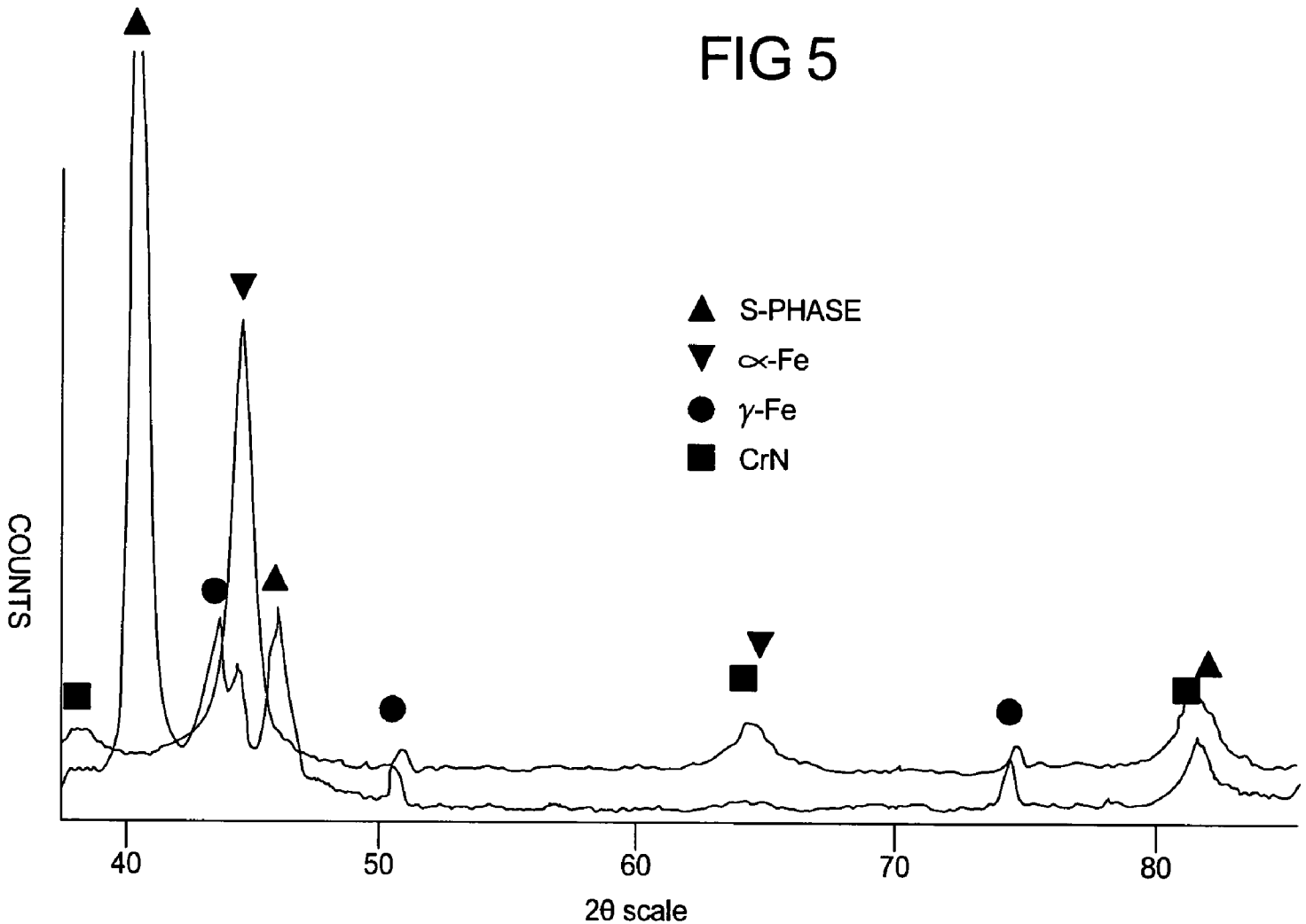
FIG. 5 is a graph of the XRD pattern of top compound layer of the plasma nitrided austenitic steel of FIGS. 3 and 4.

The compound layer formed at $N_2$=66% and $N_2$=33% shows areas of good (white) and bad corrosion resistance (dark). Especially grain boundaries were etched quite easily, which might be due to a reduction in free Cr. For $N_2$=33% XRD showed distinct S-phase peaks and small intensities of austenite (γ-Fe) and ferrite (α-Fe). At $N_2$=10% the compound layer was etched quite easily by nitrohydrochloric acid which indicates a low corrosion resistance. XRD showed distinct ferrite (α-Fe) and CrN peaks (See FIG. 5). Due to the formation of CrN, the Cr content of the matrix decreases which leads to a phase transformation from γ-Fe to α-Fe. In all cases the underlying diffusion layer was not etched at all, which indicates a high corrosion resistance. Grain boundaries are slightly visible.

Figure 6:
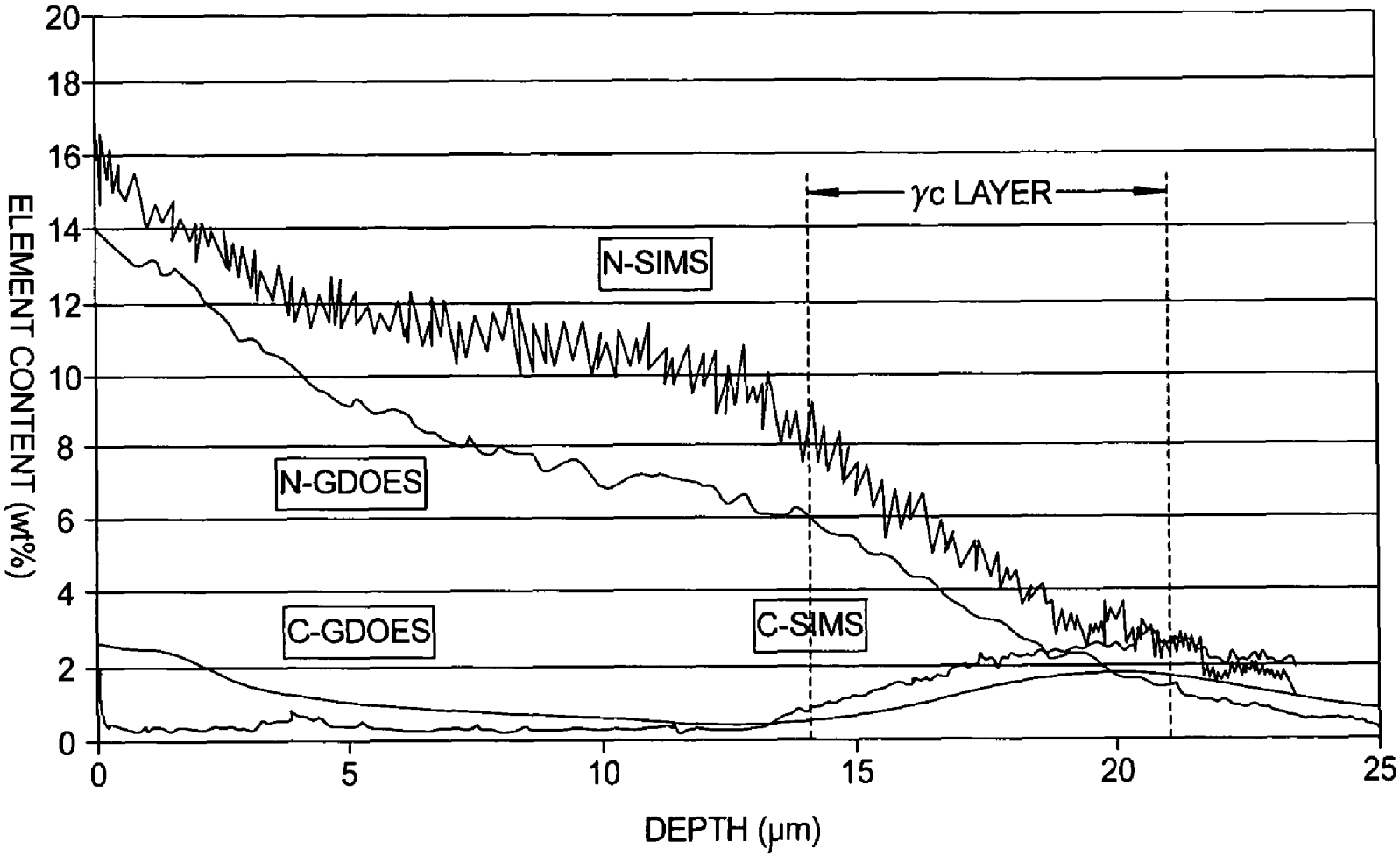
FIG. 6 is a graph of the SIMS and GDOES profiles of the plasma nitrided austenitic steel of FIG. 3.
Figure 7:
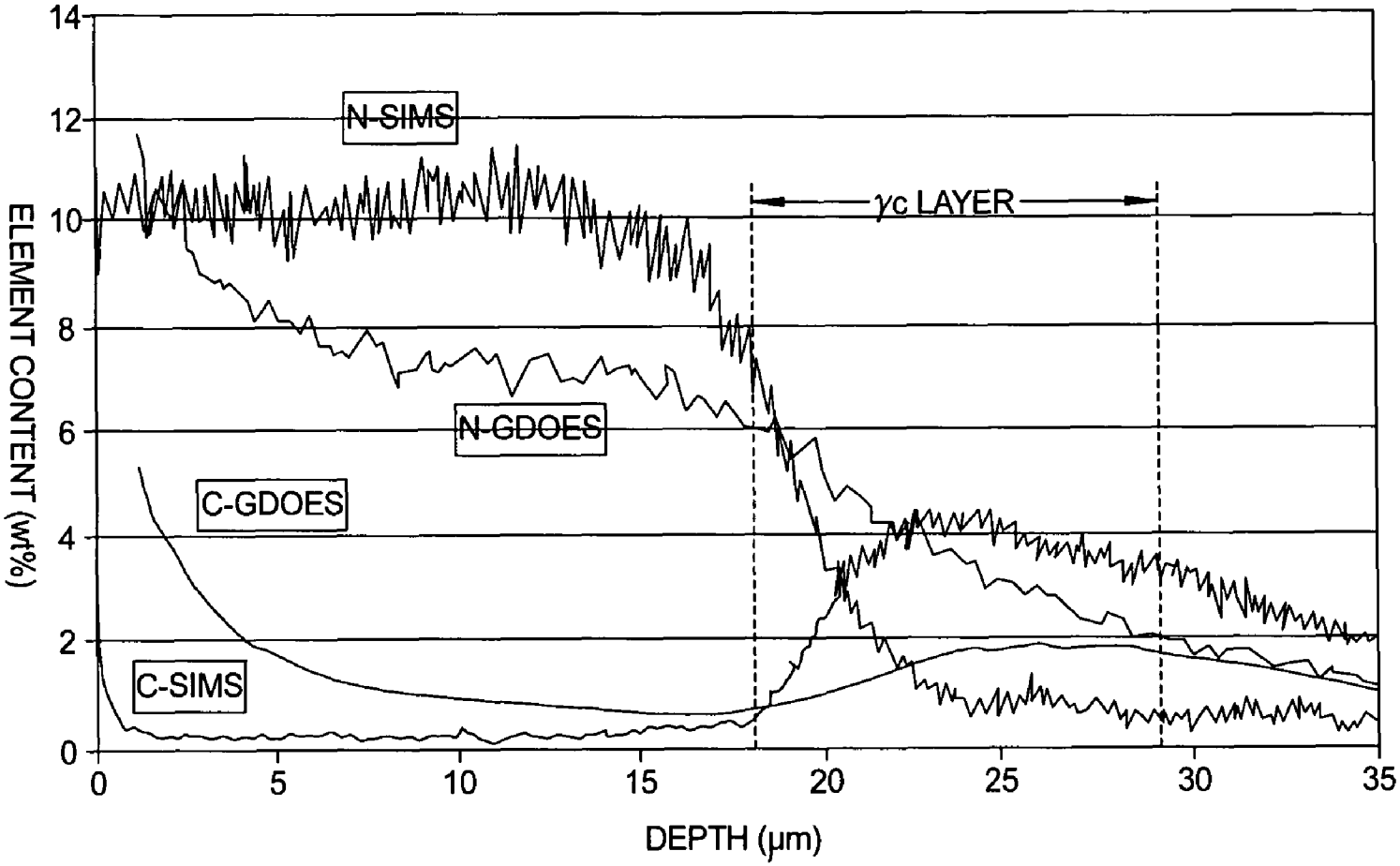
FIG. 7 is a graph of the SIMS and GDOES profiles of the plasma nitrided austenitic steel of FIG. 4.
Figure 8:
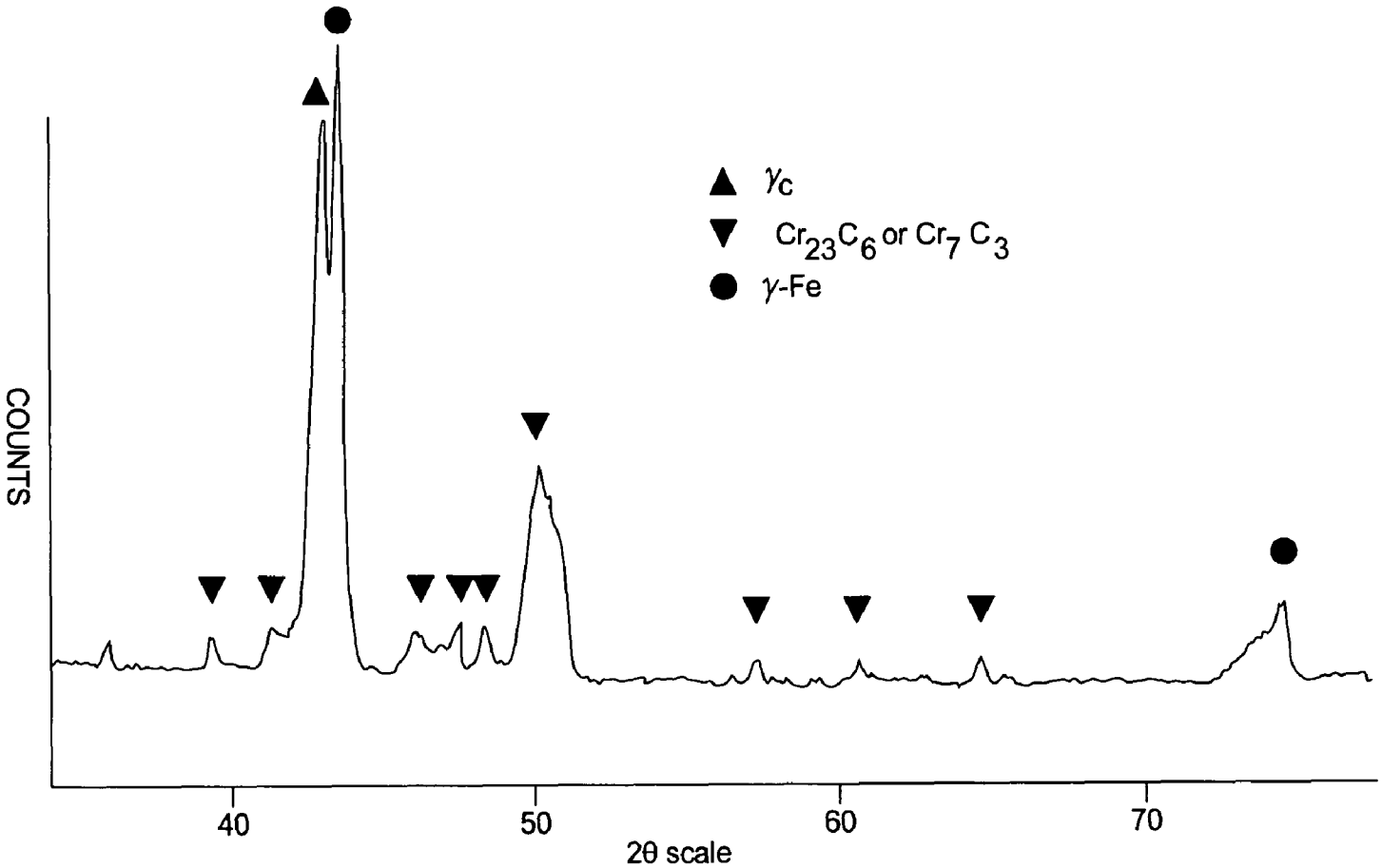
FIG. 8 is a graph of the XRD pattern of intermediate layer of the plasma nitrided austenitic steel of FIG. 3.

FIGS. 6 and 7 show the SIMS and GDOES profiles corresponding to FIGS. 3 and 4. Both measurement techniques, SIMS and GDOES do not correspond very well but they show the same tendencies. SIMS is more accurate at the very surface region (depth<5 μm) whereas GDOES measurements are usually performed for higher depths. For both $N_2/H_2$ ratios the intermediate layer is characterized by maximum N contents between 6 and 8 wt % and maximum C contents of about 0.5 wt %. The C content has a maximum within the intermediate layer. It should be appreciated that increasing the amount of austenite stabilizing elements (N is one of them) increases the diffusivity of C and thus the tendency for $M_xC_y$ (M=metal) precipitation. For 10% $N_2$, the corresponding XRD measurement (See FIG. 8) was performed after removing the compound layer by electrolytical polishing. It can be seen that this layer is a mixture of austenite (γ-Fe) and $\gamma_c$ with $Cr_xC_y$ precipitations which corresponds with the high amounts of N and C as seen in the SIMS/GDOES signals. $Cr_xC_y$ is present as very small precipitates because no carbides could be visualized by (100 ml alcohol+5 ml HCl+1 g picric acid)-etchant. Although not verified by high-resolution methods it can be assumed that there are also considerable amounts of N and C interstitial diluted in the austenite (γ-Fe). The interface to the layer (where C and N are interstitial diluted only) is characterized by N contents of 0.5 to 2.5 wt % and C contents of 1.5 to 3.5 wt % depending on the measurement technique. This is in acceptable accordance with the results that a N content of 4 wt % and a C content of 2 wt % at the interface to the diffusion layer.

Figure 9:
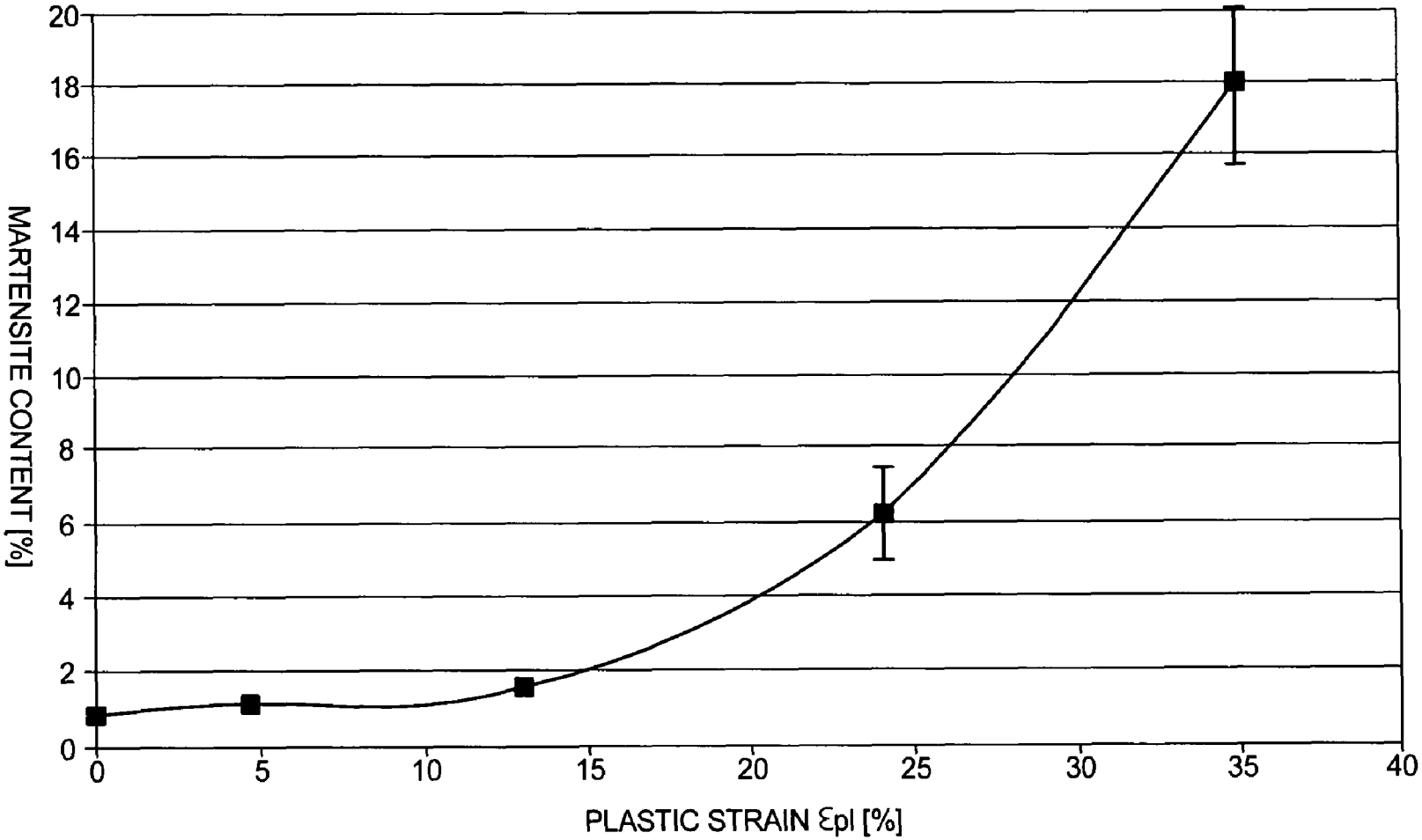
FIG. 9 is a graph of the martensite content of plasma nitrided austenitic steel strained at 20° C.
Figure 10:
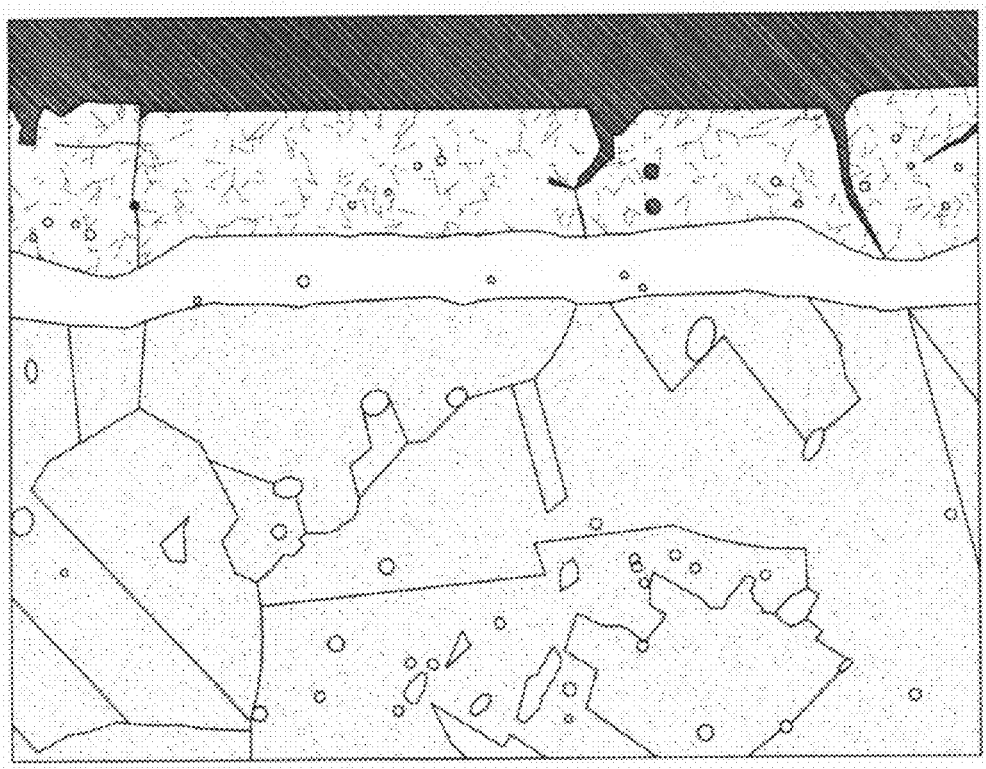
FIG. 10 is an optical photograph of a plasma nitrided austenitic steel, according to the present invention, nitrided with 33% $N_2$.and tensile strained with $\epsilon_{pl}$=5%.
Figure 11:
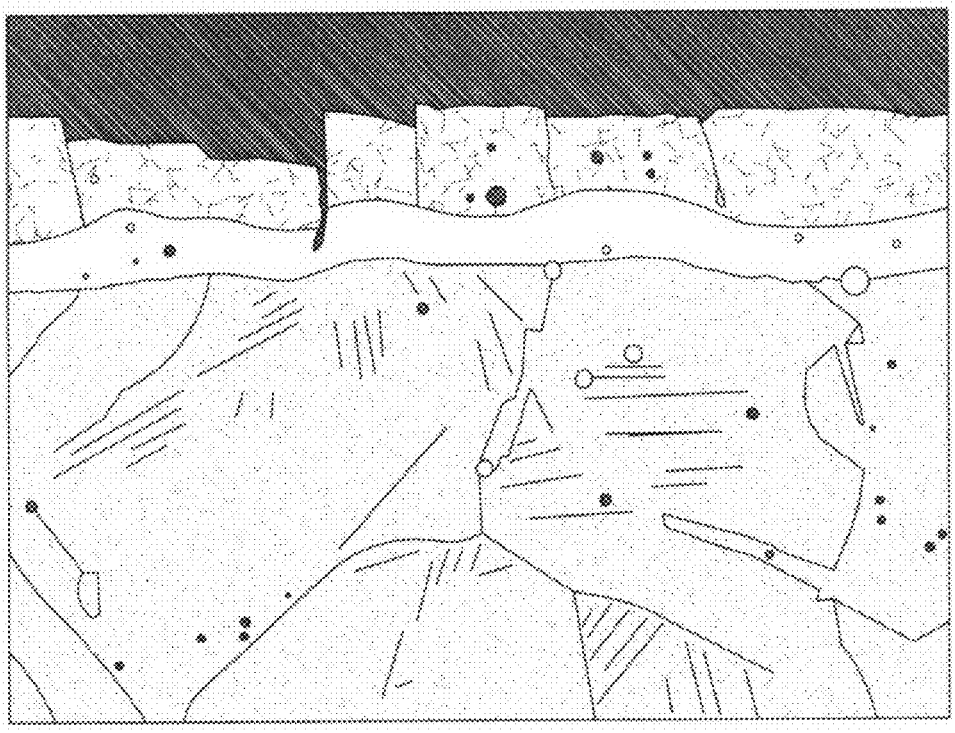
FIG. 11 is an optical photograph of a plasma nitrided austenitic steel, according to the present invention, nitrided with 33% $N_2$.and tensile strained with $\epsilon_{pl}$=35%.
Figure 12:
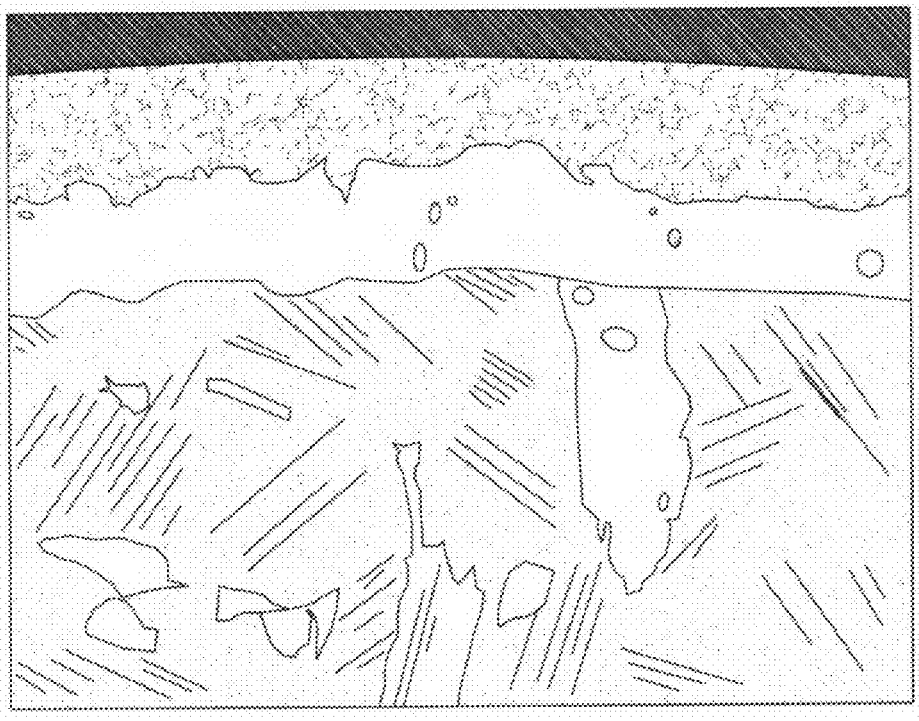
FIG. 12 is an optical photograph of a plasma nitrided austenitic steel, according to the present invention, nitrided with 10% $N_2$.and tensile strained with $\epsilon_{pl}$=35%.

FIG. 9 shows the martensite contents of the steel heat investigated here (not nitrided) at different plastic strains. There is a slight increase from 0.8 to 2% martensite content at 15% plastic strain. At higher strains the martensite content increases significantly up to 18% at 35% plastic strain. The same procedure was done with plasma nitrided specimen. FIGS. 10 and 11 show the corresponding micrographs. Even at low strains of 5% the compound layer showed cracks and some delamination which is due to the high hardness of the S-phase layer. On the other hand, the $\gamma/\gamma_C$-layer did not show any cracks at all, even at high plastic strains of 35%. The ductility of the $\gamma/\gamma_C$-layer is similar to that of the base material without any visible damage. FIG. 12 shows a micrograph of the specimen nitrided with 10% $N_2$ and a plastic deformation of 35%. This cross section was etched with Beraha II etchant which is a special etchant for the detection of martensite. It appears as dark grey/black needles in the two dimensional plane. The martensite formation within the base material is clearly visible and it stops right at the interface between the diffusion layer and the $\gamma/\gamma_C$-layer. Some martensite needles slightly penetrate into the $\gamma/\gamma_C$-layer but only for one or two μm. This stability of the structure is a precondition for a protection layer to prevent HEE of low grade austenitic SS. It can also be seen that at 35% plastic deformation there is no additional zone free of martensite within the diffusion layer. This means that the structure of the diffusion layer is not stabilized by the interstitial dilution of N and C in a way that the formation of martensite is prevented.

Figure 13:
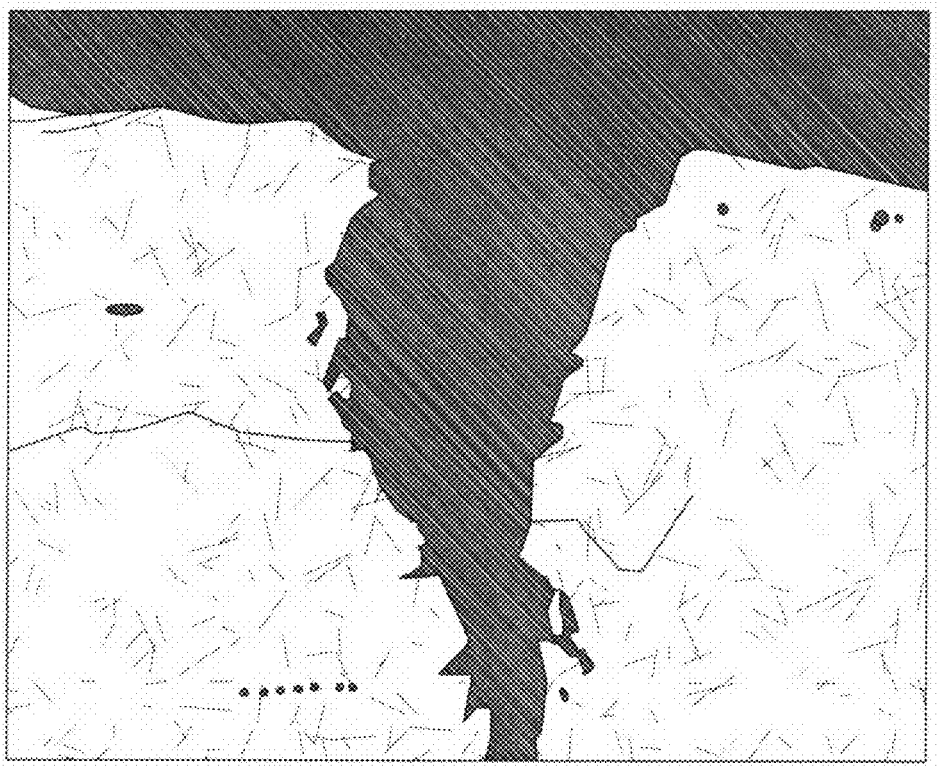
FIG. 13 is a cross-sectional view of a treated austenitic steel, according to the present invention, plasma nitrided with 66% $N_2$ and tensile tested in gaseous hydrogen and illustrated with both nitriding layers removed.
Figure 14:
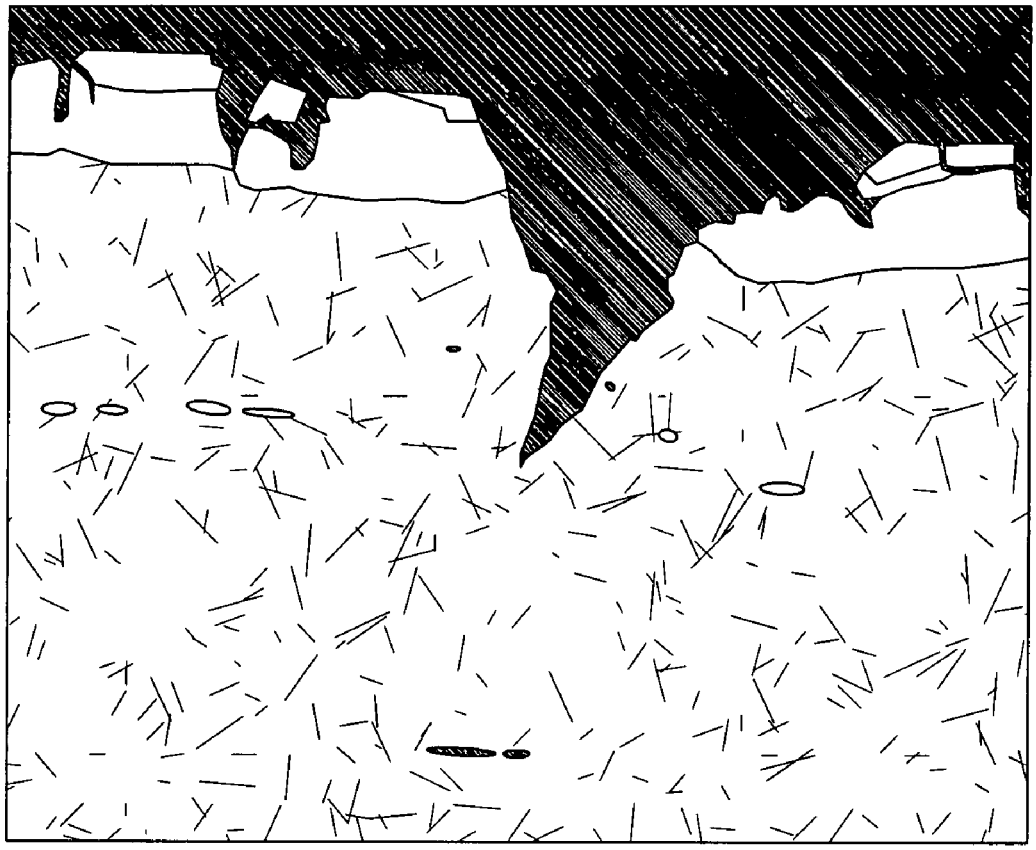
FIG. 14 is a cross-sectional view of a treated austenitic steel, according to the present invention, plasma nitrided with 66% $N_2$ and tensile tested in gaseous hydrogen and illustrated with the compound layer not removed.
Figure 15:
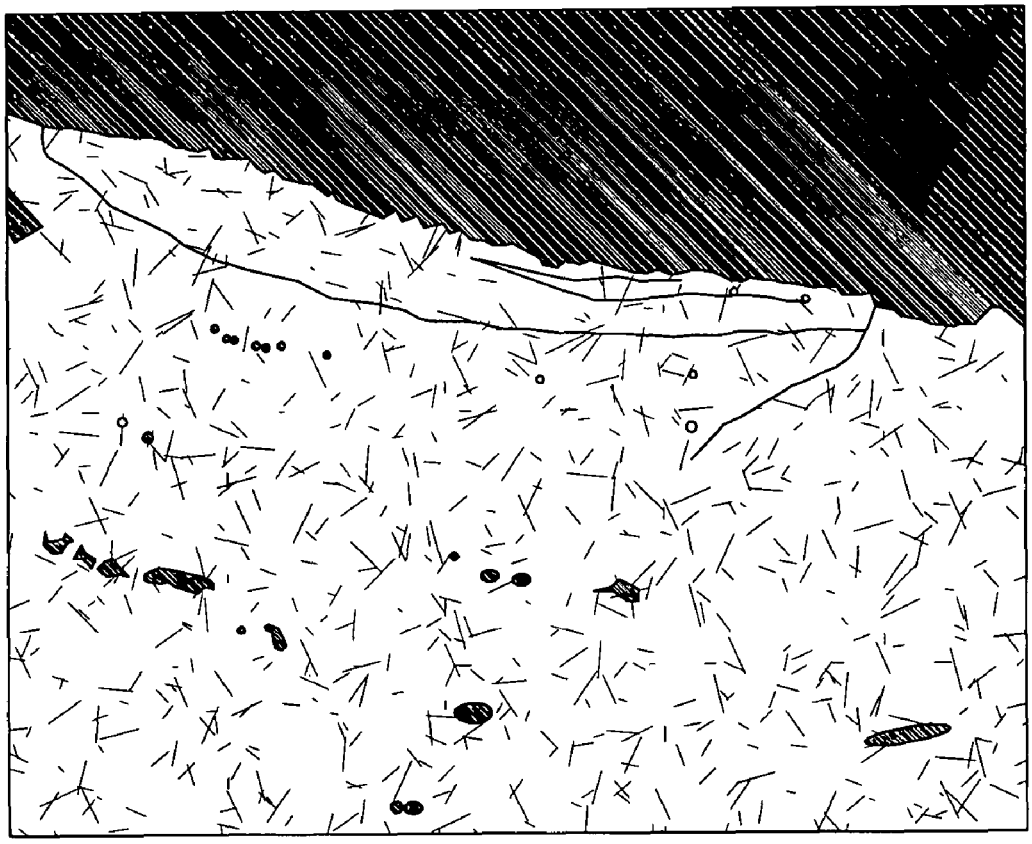
FIG. 15 is a cross-sectional view of a treated austenitic steel, according to the present invention, plasma nitrided with 66% $N_2$ and tensile tested in gaseous hydrogen and illustrated with only the compound layer removed.

It was known from previous investigations that all specimens contain a double layer structure. To investigate the properties of the individual layers under hydrogen atmosphere, the cylindrical test length of one single tensile specimen was prepared as follows: as nitrided, no modification; removal of the compound layer; removal of both layers, compound and $\gamma/\gamma_C$-layer. The results are shown in FIGS. 13 through 15. Areas where both nitriding layers were removed suffered from severe hydrogen embrittlement characterized by deep transgranular cracks (FIG. 13). This result could be expected because it is known that 1.4301 grade stainless steel show severe hydrogen embrittlement. Areas with the as nitrided surface showed severe embrittlement as well also characterized by deep transgranular cracks (FIG. 14). In FIG. 14, also the brittle behaviour of the compound layer is visible. Due to the high brittleness of this layer, cracks and thus new metal surfaces are formed very easily. As previously explained, plastic deformation combined with new metal surfaces are a precondition for hydrogen embrittlement. Since crack tips are very reactive sites it should be appreciated that the cracks propagate deep into the material. FIG. 15 shows the area where only the compound layer was removed. The $\gamma/\gamma_C$-layer remained completely intact and does not show any cracks. Since all results were obtained from one sample where direct interaction cannot be ruled out, this cannot be taken as a direct proof but as a hint that a $\gamma/\gamma_C$-layer can protect an underlying 1.4301 type SS from hydrogen embrittlement. Proving this assumption requires the development of a nitriding process where only a $\gamma/\gamma_C$-layer is produced.

Referring to FIGS. 16 through 19, another embodiment, according to the present invention, of the plasma nitriding is shown. In this embodiment, the object of this invention is to disclose meta-stable austenitic steel of type 18/8-Cr/Ni whose surface area is doped with nitrogen. Nitrogen doping of the surface has three main effects to make a surface resistant to hydrogen embrittlement: nitrogen in small amounts stabilizes the austenitic structure; nitrogen in small amounts is interstitially diluted in the lattice, which creates a compressive stress at the surface. Therefore, a higher amount of tensile stress is necessary to produce local plastic deformation, which is a precondition for hydrogen embrittlement; and nitrogen in small amounts is interstitially diluted in the lattice, which reduces the diffusion coefficient of hydrogen. Therefore, more time is needed for the hydrogen to diffuse to critical areas where it can act detrimental.

Figure 16:
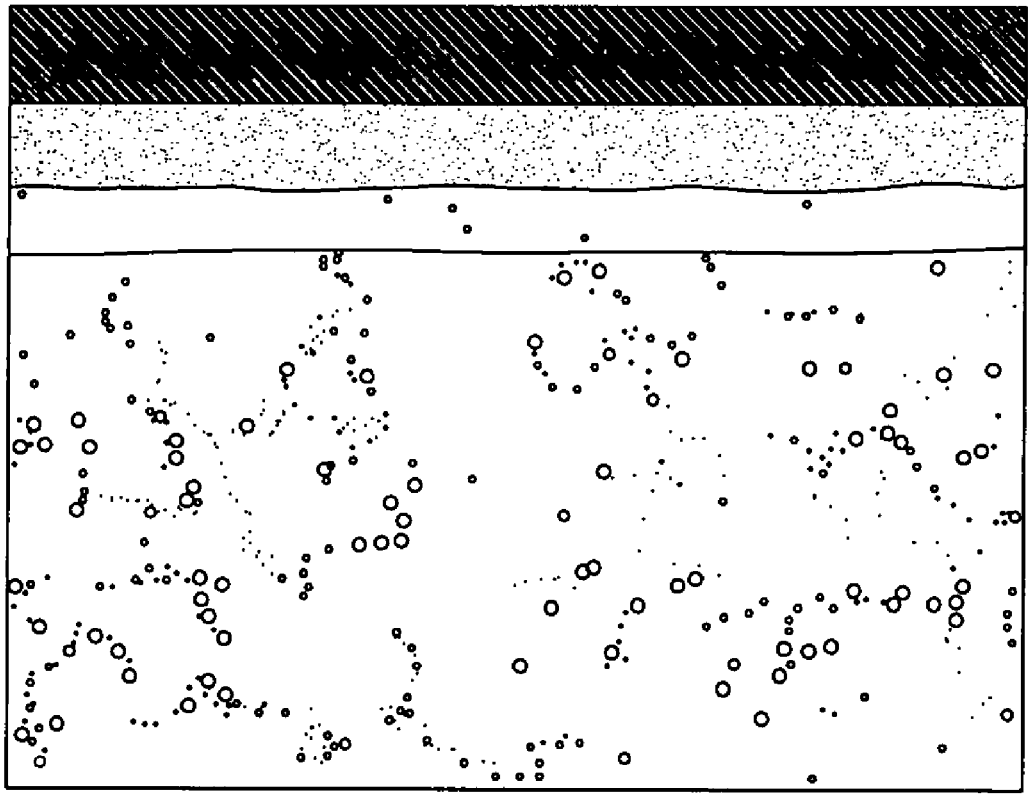
FIG. 16 is a cross-sectional view of a plasma nitrided austenitic steel, according to the present invention, illustrated with both compound and diffusion layers.

The purpose of the present invention is to improve the stability of the structure and thus to improve durability. Corrosion resistance is of minor importance. The most suitable ways to incorporate Nitrogen into austenitic stainless steel are "Plasma Nitriding" (PN) and "Plasma Immersion Ion Implatation" (PIII). The general structure of a nitrided surface is a bi-layer structure comprising a compound layer at the top and an underlying diffusion layer as seen in FIG. 16.

Figure 17:
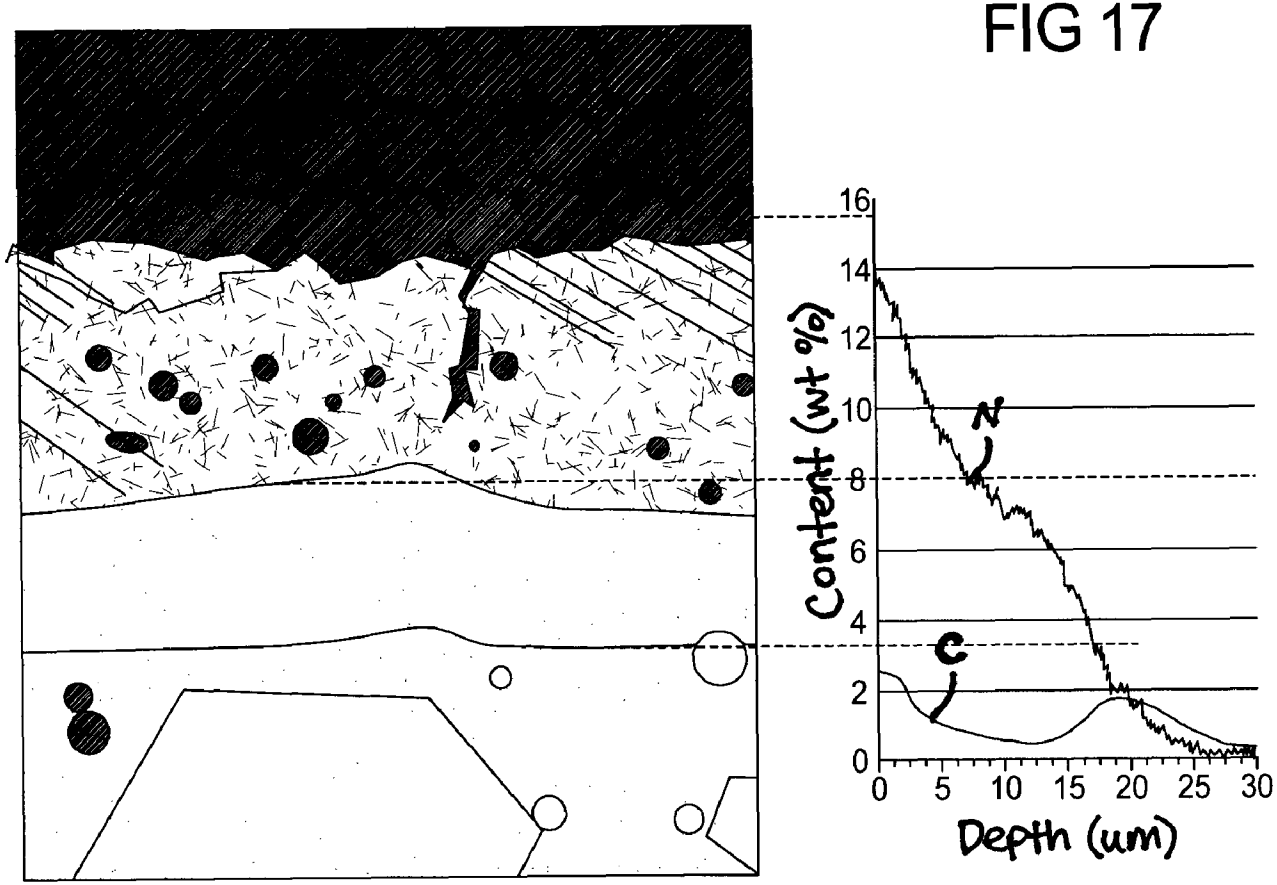
FIG. 17 is a cross-sectional view of a plasma nitrided austenitic steel, according to the present invention, illustrated with corresponding N and C contents.

FIG. 17 illustrates the cross section of plasma nitrided 1.4301 with the corresponding Carbon (C) and Nitrogen (N) contents. Clearly visible is a diffusion layer, which is not etched by etchant $HCL+HNO_3$. The diffusion layer consists of up to 2 wt % of carbon and up to 6 wt % of nitrogen as measured by GDOES (Glow Discharge Optical Emission Spectroscopy). These contents were verified by SIMS (Secondary Ion Mass Spectroscopy). The corresponding XRD (X-Ray Diffraction) pattern is illustrated in FIG. 18. It can be seen that the diffusion layer consists of austenite (γ-Fe) and—to a much minor degree—of chromium nitrides ($Cr_2N$) and chromium carbides of different stoichiometry ($Cr_xC_y$). Since Cr has a higher affinity towards C and N compared to Fe, it makes sense that chromium nitrides and carbides are formed first. Since no iron nitrides and carbides were detected, it can be assumed that there is a significant content of C and N in the austenitic structure. Due to this alloying, the stability of the austenitic structure is enhanced.

FIG. 19 illustrates the same specimen as shown in FIG. 17 after a plastic deformation of 35%. In the base material, a significant amount of martensite plates was created due to the instability of the austenitic structure (dark areas). It can also be seen that the formation of martensite stops rapidly at the borderline of untreated steel to the diffusion layer. In the diffusion layer, no martensite could be detected. This is a clear indication that the structure of the martensite contains mainly completely stable austenite, which was reached by alloying the former metastable structure with N and C. It should be appreciated that stabilization of the surface area reduces the propagation of hydrogen induced cracks and thus delays fracture due to hydrogen embrittlement. It should also be appreciated that the treated surface areas prevent the formation of cracks at the surface, which may prevent component failure.

Figure 20:
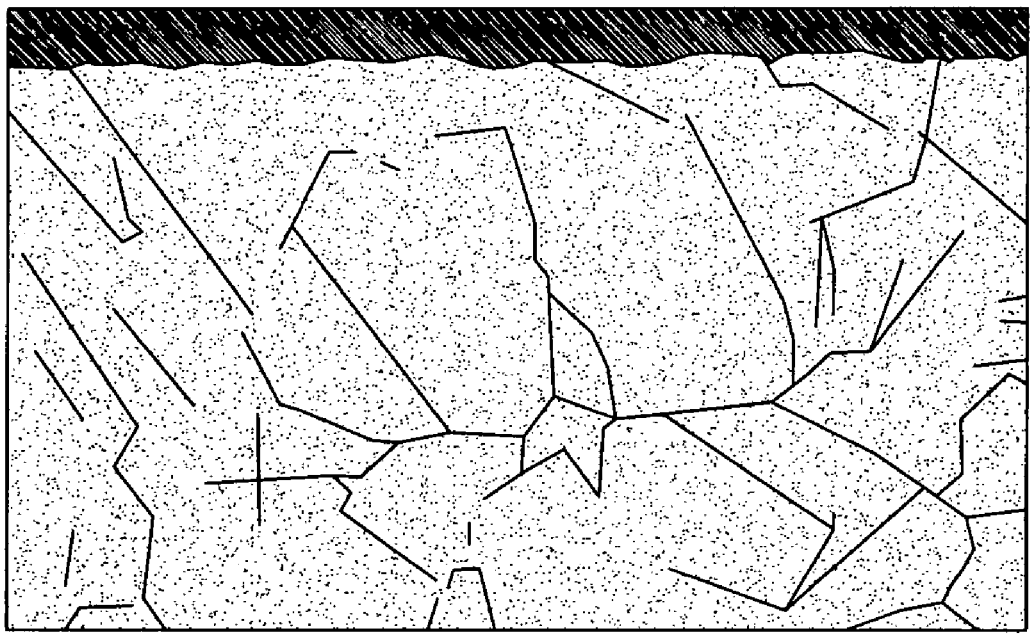
FIG. 20 is an optical photograph of a carbonized austenitic steel, according to the present invention.

Referring to FIG. 20, another embodiment, according to the present invention, of treating austenitic steel is shown. In this embodiment, the object of this invention is to disclose meta-stable austenitic steel of type 18/8-Cr/Ni whose surface area is doped with carbon to make it stable. Doping has to be performed in a way that the formation of metal carbides (e.g., chrome carbides, iron carbides, etc.) does not occur. This is usually reached by a diffusion treatment at low temperatures (<300° C.). The purpose of the present invention is to improve the stability of the structure and thus to improve durability. It should be appreciated that corrosion resistance is of minor importance.

The most suitable ways to incorporate carbon into austenitic stainless steel is a low temperature diffusion treatment with or without plasma. One technique is known as "Kolsterising" by Bodycote Hardiff, Netherlands. The result of kolsterized austenitic stainless steel is shown in FIG. 20. The kolsterized surface is characterized by a high amount of carbon in interstitial solution and no presence of metal carbides, which leads to an enhanced wear resistance without a decrease in corrosion resistance. It should be appreciated that the incorporation of carbon stabilizes the austenitic structure. It should also be appreciated that, for hydrogen applications, the surface is protected against hydrogen embrittlement.

Accordingly, plasma nitriding of 1.4301 stainless steel produces a bi-layered structure comprising a S-phase compound layer and an intermediate $\gamma/\gamma_C$-layer. Plastic deformation of the plasma nitrided specimen showed cracks and some delamination of the S-phase layer, whereas the $\gamma/\gamma_C$-layer behaved very ductile. Even at a plastic deformation of 35% no cracks or any other damage was visible. A tensile test in gaseous hydrogen showed severe embrittlement of the not nitrided steel and the nitrided steel with S-phase layer. No cracks were observed in areas where just the $\gamma/\gamma_C$-layer was present. These are promising results for a protection layer against hydrogen embrittlement of metastable stainless steels. Possible reasons for these results might be N stabilizes the austenitic structure. The interstitial dilution of N leads to compressive stresses that counteract the operational tensile stresses. The interstitial dilution of N reduces the diffusion speed of H because interstitial sites are blocked by N. Since interstitial Carbon is also an austenite stabilizing element, a (plasma-) carburisation or nitro-carburisation should give similar promising results.

The present invention has been described in an illustrative manner. It is to be understood that the terminology, which has been used, is intended to be in the nature of words of description rather than of limitation.

Many modifications and variations of the present invention are possible in light of the above teachings. Therefore, within the scope of the appended claims, the present invention may be practiced other than as specifically described.

The invention claimed is:

1. A treated austenitic steel comprising:

an austenitic steel;

a non-metal chemical element incorporated into a surface of said steel;

said surface having a diffusion layer, wherein said diffusion layer protects said surface against hydrogen embrittlement; and wherein said austenitic steel is nitrided with one of 33 vol % and 66 vol % $N_2$.

2. A treated austenitic steel comprising:

an austenitic steel;

a non-metal chemical element incorporated into a surface of said steel;

said surface having a diffusion layer, wherein said diffusion layer protects said surface against hydrogen embrittlement; and wherein said austenitic steel is tensile strained with one of $\epsilon_{pl}$=5%, 15%, 25%, and 35%.

3. A treated austenitic steel comprising:

an austenitic steel;

a non-metal chemical element incorporated into a surface of said steel;

said surface having a diffusion layer, wherein said diffusion layer protects said surface against hydrogen embrittlement; and wherein said austenitic steel is nitrided with one of 10 vol %, 33 vol %, and 66 Vol % $N_2$ and tensile strained with one of $\epsilon_{pl}$=5%, 15%, 25%, and 35%.

4. A treated austenitic steel comprising:

an austenitic steel;

nitrogen and carbon being incorporated into a surface of said steel;

said surface having a diffusion layer, wherein said diffusion layer protects said surface against hydrogen embrittlement; and wherein said diffusion layer has a nitrogen content between about 6 wt % and 8 wt % and a carbon content of between about 0.5 wt % and 2 wt %.

5. A treated austenitic steel as set forth in claim 4 wherein said austenitic steel comprises a stainless steel.

6. A nitrided austenitic steel comprising:

an austenitic steel;

nitrogen being incorporated into a surface of said steel;

said surface having a bi-layered structure comprising an S-phase compound layer and an intermediate $\gamma/\gamma_C$-layer, wherein said intermediate $\gamma/\gamma_C$-layer protects said surface against hydrogen embrittlement; and wherein said austenitic steel is nitrided with one of 33 vol % and 66 vol % $N_2$.

* * * * *